US006409447B2

(12) United States Patent
Malmros

(10) Patent No.: US 6,409,447 B2
(45) Date of Patent: Jun. 25, 2002

(54) BOOKBINDING SIGNATURE COMB AND SPINE DEVICE

(75) Inventor: Mark Kent Malmros, Washington Crossing, PA (US)

(73) Assignee: Tanarax, LLC, Washington Crossing, PA (US)

( * ) Notice: Subject to any disclaimer, the term of this patent is extended or adjusted under 35 U.S.C. 154(b) by 0 days.

(21) Appl. No.: 09/756,595

(22) Filed: Jan. 9, 2001

Related U.S. Application Data

(60) Provisional application No. 60/179,936, filed on Feb. 3, 2000.

(51) Int. Cl.[7] ..... B42C 1/00; B42B 9/00

(52) U.S. Cl. ..... 412/40; 402/7; 402/8; 402/9; 402/14; 402/15; 402/500; 281/21.1; 281/28; 270/32; 270/38; 270/58.08; 270/52.14; 270/52.18; 412/4; 412/6; 412/20; 412/33; 412/34; 412/38; 412/39; 412/43

(58) Field of Search ..... 412/4, 6, 20, 33, 412/34, 38, 39, 40, 43; 281/21.1, 28; 270/32, 38, 58.08, 52.14, 52.18; 402/7, 8, 11, 9, 14, 15, 500

(56) References Cited

U.S. PATENT DOCUMENTS

| | | | | |
|---|---|---|---|---|
| 3,956,798 A | * | 5/1976 | Wright | 281/21.1 |
| 3,965,538 A | | 6/1976 | Caveney et al. | |
| 4,408,780 A | | 10/1983 | Detterman et al. | |
| 4,525,116 A | | 6/1985 | Holmberg | |
| 4,997,208 A | | 3/1991 | Staats, III | |
| 5,626,432 A | | 5/1997 | Swift et al. | |
| 5,725,251 A | | 3/1998 | Heggeland | |
| 5,895,190 A | | 4/1999 | Viola | |
| 6,062,792 A | | 5/2000 | Garrity | |

* cited by examiner

*Primary Examiner*—A. L. Wellington
*Assistant Examiner*—Mark T. Henderson

(57) ABSTRACT

A method of binding folded signature sections together into a book comprised of a signature comb element having teeth which are inserted through perforations in the fold of the signatures and the teeth having tabs which secure the signature comb in slots between two or more spine tapes. The spine tapes adjustably lock into the hinge of the covers by a tooth and pawl mechanism, further interlocking one or more signatures to the spine of the book and securely fasten together the signatures and book cover.

4 Claims, 6 Drawing Sheets

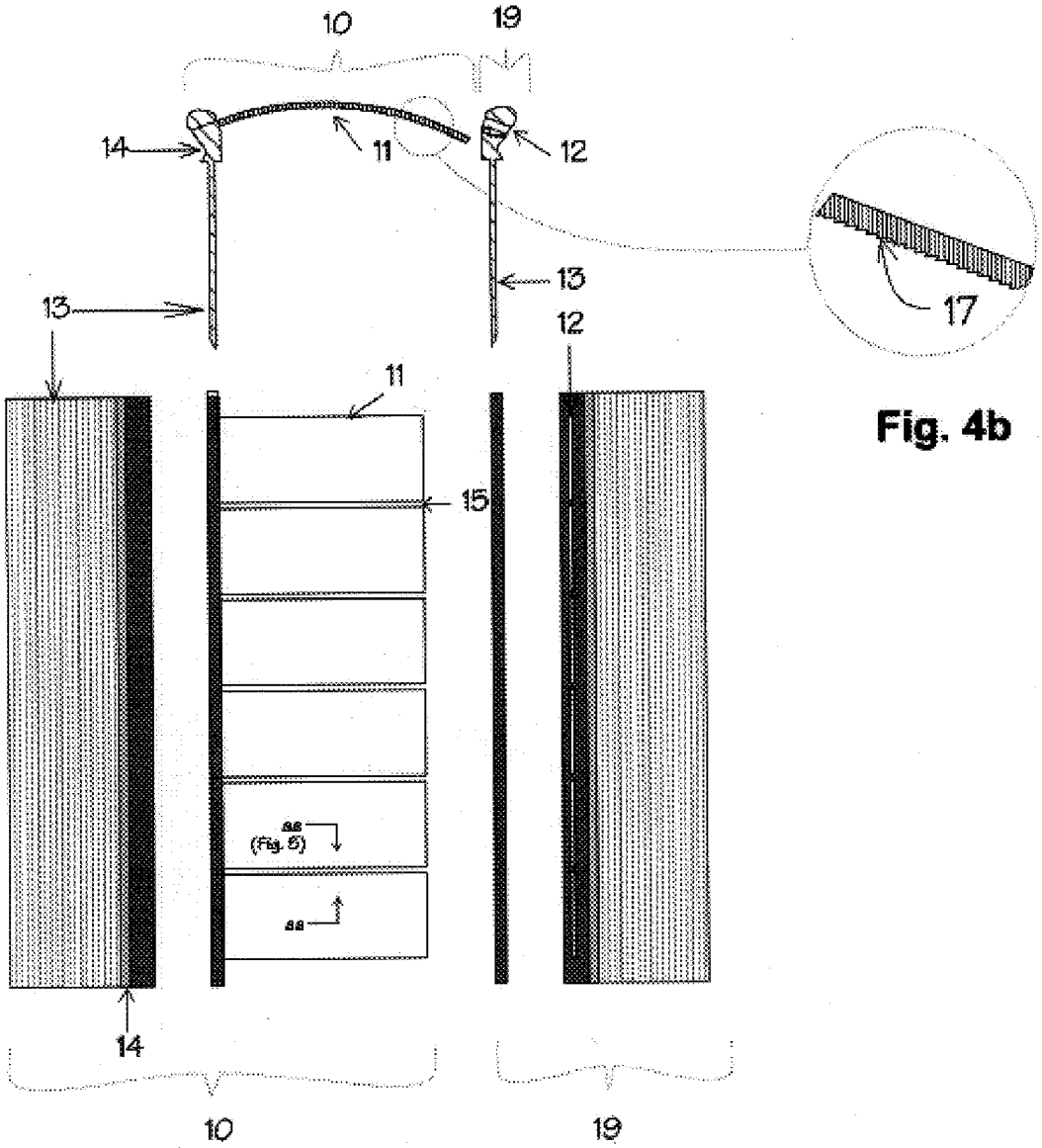
Fig. 4b
Fig. 4a
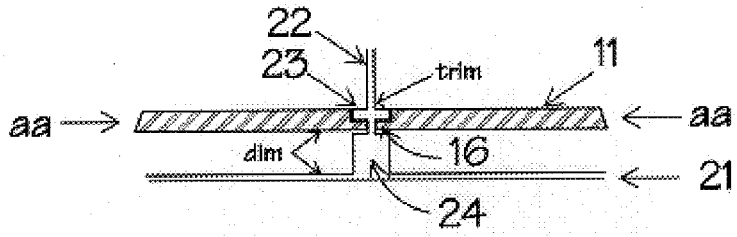
Fig. 5

BOOKBINDING SIGNATURE COMB AND SPINE DEVICE

This application claims the benefit of U.S. Provisional Application No. 60/179,936 filed Feb. 3, 2000.

BACKGROUND OF THE INVENTION

The binding of books in signature form has little changed from antiquity. Whether binding is done by hand, or by machine, the pages of a book are so printed that groups (signatures), usually of no less than sixteen pages, can be sewn together in binding. Since we are printing in two-page forms (folio imposition), that means that a signature will consist of four sheets, each folded once down the middle and laid one inside another. The outside sheet will carry the first and last pages of the signature, say pages 1 and 16, on one side, backed up by pages 2 and 15. The next sheet will carry pages 3 and 14, backed up by 4 and 13. And so on to the middle of the signature, where pages 8 and 9 will form the center spread.

Gathering, sewing, and trimming. For hand binding, all the signatures of the book are first gathered in correct order. Then one by one they are sewn, with needle and linen thread, through the fold and around cords or over flat linen tapes held taut in a sewing frame. Small "kettle stitches" near the top and bottom of each signature link it to the adjacent ones. When all signatures have been sewn, they and the cords or tapes are removed from the sewing frame, and the endpapers (often decorative) are attached (tipped) to the outside signatures with a thin line of paste or glue. (Alternatively, the endpapers may have been sewn in with the signatures.) The spine is then knocked square and the book is trimmed, usually on all three exposed sides. A coating of flexible glue is commonly applied to the spine at this point, to help hold everything together.

Case binding was the first fully mechanized method to be developed for binding books. The direct descendant of the hand-binding method described earlier, case binding (also called editing binding and hard-back binding) is still employed for most trade and scholarly books. It produces a machine-bound book that superficially resembles a hand-bound one, although the binding differs structurally and is not as strong. Folding and collating. Like all binding methods, case binding begins with folding the press sheets and gathering the signatures in order (collating here done by machine. In book printing, 8, 16, or, more frequently, 32 pages are printed at one time on one side of the sheet and backed up with the same number on the other side, for signatures of 32 pages Large sheets are usually cut to 32-page size before folding). If separately printed plates are to be included in the book, they are added to the signatures by wrapping, inserting, or tipping.

Sewing. The signatures are then sewn, through the folds and to each other, but not around cords or tapes, as in hand binding. This is Smyth (rhymes with blithe) sewing. In side sewing the stitches go through all the signatures at once from the side. It is stronger than Smyth sewing, but the book will not open flat. After sewing, end sheets are tipped on, and the sewn book is smashed (squeezed in a press to remove air) and trimmed. Forwarding. Next comes the sequence of operations collectively known as Forwarding. These include a preliminary gluing of the spine, as in hand binding, rounding and backing, here performed by forcing the clamped sheets against steel rollers rather than by pounding, and finally, lining. Lining provides a hinge between the book and the cover. A piece of stout gauze (super) somewhat wider than the book is thick is glued to the spine with its edges extending outward. A strip of heavy paper is glued down over the super, with the headbands tucked under the super at the top and bottom. (Since the head-bands are almost purely decorative in a case-bound book, they are sometimes left out to save money.)

Casing in. The book is now ready to be cased in, or enclosed in its cover. Unlike the cover of a hand-bound book, the case is completely preformed, with boards and paper buckstrip pasted to the printed or stamped cloth, before it is joined to the book. Like all the other operations described, casing in is an automatic process in a modern bindery. The endpapers are given a coat of paste just before the case is joined to the book.

Perfect bound books are stacks of single sheets that are glued together along one edge. This type of book is comparatively less expensive to produce but results in a poorer quality binding that does not open well or lay flat and often will come apart after frequent or hard use. Such perfect bound books are not considered to be of archival quality lacking the durability to withstand hard and long usage.

Other modern and expedient methods of binding books, such as spiral wire binding, stapling, ring binding and the like are also to be found in the book manufacturing trade.

DESCRIPTION OF THE INVENTION

The present invention not only utilizes modern materials and methods, but also further recognizes the evolution in the publishing and distribution of books and related printed textual material. Because of book manufacturing expenses, a publisher has the book printed and machine bound in large numbers to keep the individual copy cost low. Books with a smaller market often cost more per copy to produce. Inventory, distribution, and shipping of books further add to the cost of producing a book.

With the evolution of the digital personal computer, digital communications such as the Internet, and with high quality reasonable cost digital printer technology, such as laser and ink jet printers, there is a growing trend to shift the manufacture of a book from large scale production methods to individual "books on demand". A book can be written, edited, designed, composed, distributed and printed all from the software programming of a digital personal computer. As a consequence, there is a new means of publishing books. Some of this book publishing technology looks to a digital computer as the final product to be used for "reading" the book. Whereas the production and distribution of "conventional" books are similarly being revolutionized. However, the final product of a book is the bound printed page and the technology for producing this part of the product has changed little in recent years.

The present invention incorporates the utility of being able to print and bind a finished book from a digital computer and printer, anywhere and anytime, without the need for machinery, tools, equipment, or special skills. Further, the utility of the present invention provides for a simple means to bind a book without glue and clamps in just a few minutes. This would produce a book of archival quality with the durability of sewn signature bound books with the desirable feature of opening and laying flat during use.

The present disclosure describes a device and corresponding method for binding folded sheets of paper in signatures and further binding signatures into book form. The device replaces the classical method of sewing signatures together by means of thread and glue with use of a pre formed signature comb, the "teeth" of which pass through perforations in the fold of each signature (and consequently each sheet of the signature); signature comb tooth fastening at the back or spine of the signature by attaching to a pre formed interlocking spine tape and spine hinge; and where more than one signature being bound together by a plurality of interlocking signature combs in the preformed spine. The spine may be designed so as to include a variety of means for securing the collected and bound signatures to a cover, in other words to "case in" the bounds signatures to a book cover. It is readily seen that this method is simple to effect resulting in a book bound in signature form having the desirable characteristics of ease of opening, permanency, durability of binding and so forth.

The device provides a method requiring no additional equipment, machinery, tools or skills, further requiring no adhesive or glue, enabling relatively unskilled persons to easily bind a book or a few copies of a book, on demand, and in very little time. Further, the device and corresponding method is seen to also be adaptable to mechanized assembly (binding) in large volume bookbinding production.

The following description and drawings are of a preferred means of embodiment of the general concept and is not intended as a limitation to the scope of the disclosed invention or inventive concept.

As an anecdotal introduction to the Description of the Drawings, the concept and visualization of the following may be enhanced by having at hand a common "electrical cable tie" strip (available at hardware and home improvement stores) which irreversibly interlocks into itself (by means of teeth and a pawl) for bundling together a plurality of wire cables; and further a common plastic tag tie used to secure sales tags to articles of clothing in retail stores.

Figure 1:
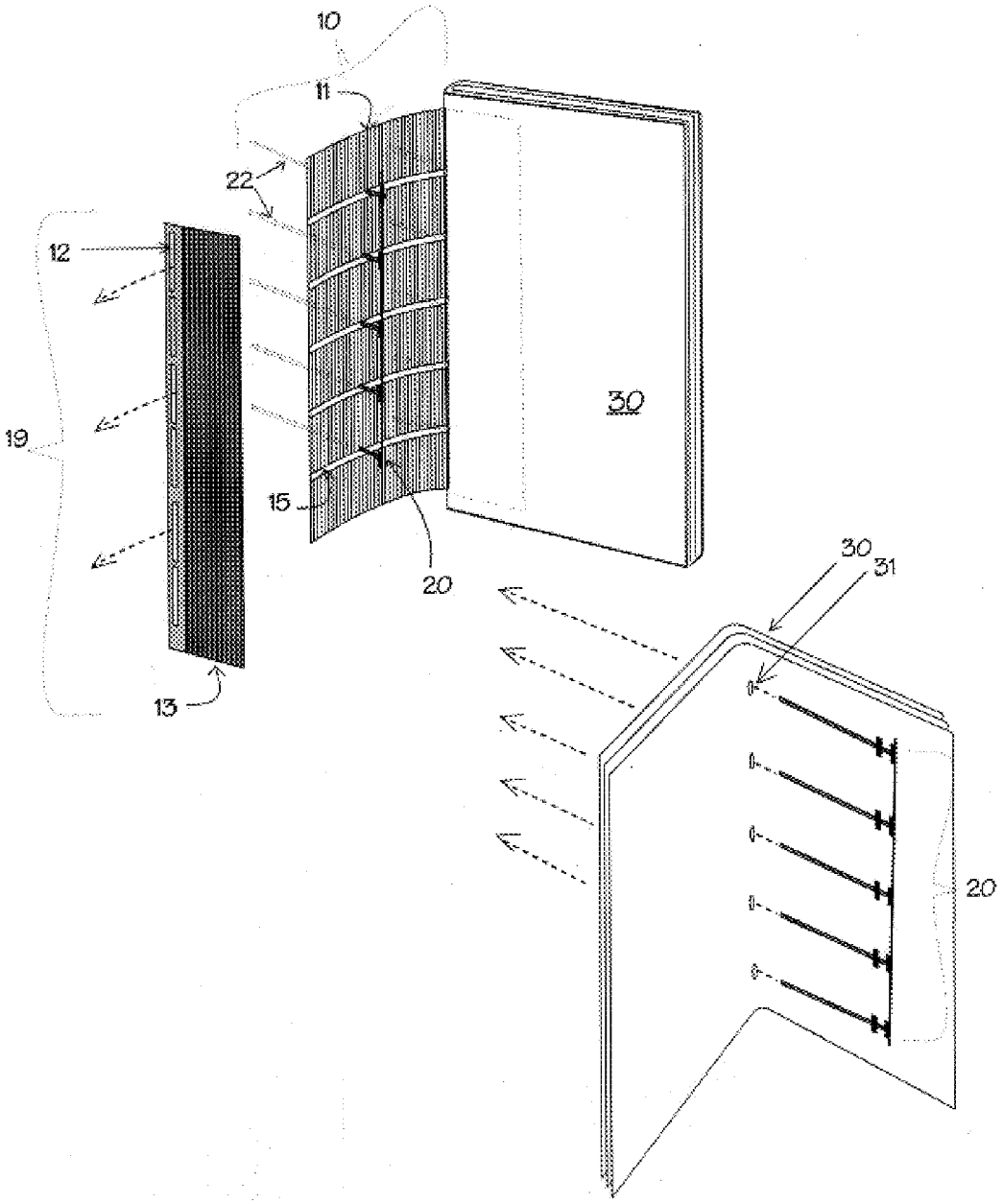
FIG. 1 is an exploded view of the elements in assembling or binding together folded sections or signatures of a book using a signature comb 20 and a two-piece interlocking spine 10 & 19. The teeth of a signature comb 22 pass through perforations 31 in the fold of each signature 30 and through slots 15 between the spine tapes 11 of spine hinge 10. The teeth are secured by a tab 23 (see FIG. 3) which rides on the sill of the groove 16 (see FIG. 5) of each slot 15 between the spine tapes and secures the back of the signature 30 to the back of the spine tapes.

When all teeth 17 of each signature comb for all signatures or sections desired to be bound together are placed into the slots 15 of one spine hinge 10, the spine is completed by passing the spine tapes 1t having rows of teeth 17, into the pawl slots 12 of the complementary spine hinge 19 clamping the signatures between the sides of the spine hinges thereby binding together the book.

Figure 2:
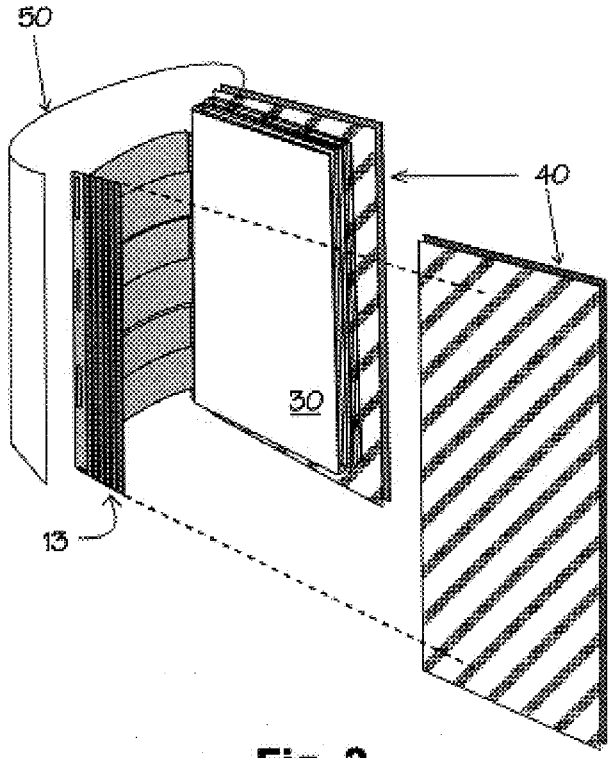

FIG. 2 shows the assembly of pre-slotted cover boards 40 onto the large tabs 13 of the assembled spine hinges. Covering material for the spine 50 is further attached to finish the covering of the book.

FIGS. 3 and 4 show plan views of the components used in binding signatures into a book by this method. All components of the signature comb and spine elements are manufactured of polymers or polymer composites by means of one, or a combination of methods such as injection molding, die stamping, extrusion and so forth. The method of manufacture and material used is based on obtaining the desirable characteristics of strength and flexibility required to bind a book together with durability and archival longevity.

Figure 3A:
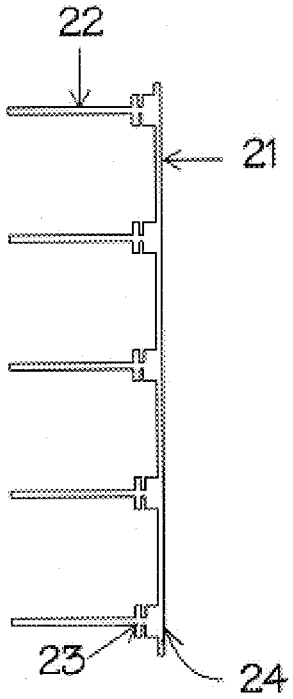
Figure 3B:
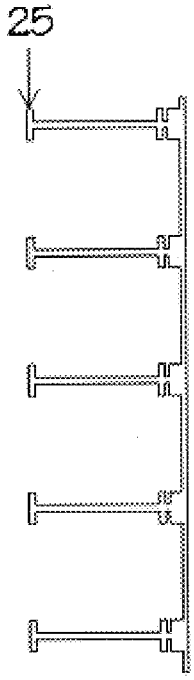

The signature comb is shown in two variations in FIG. 3. Referring to FIG. 3*a*, the teeth of spine comb 22 pass through perforations in the fold of the signature pages (see FIG. 1 (31)) as well as the tab elements (23 and 24); the back of the spine comb 21 coming to rest securely in the fold of the signature. FIG. 3*b* shows the same basic design of the spine comb with the addition of tabs 25 which can be used to assist in both inserting the spine comb through the signature perforations as well as assisting in placing the signature combs and signatures into the slots 15 of the spine tapes 11. These additional tabs 25 may be useful for both a manual as well as a mechanized way to bind books with this device, facilitating the insertion of the signature combs through the slots in the fold of the signatures.

FIG. 4 shows plan views of the spine hinge elements 10 & 19. One spine hinge element 10 has a row of spine tapes 11 separated by slots 15 and have rows of teeth 17 (or ridges) on the side against which the back of the signatures rest and which are closely spaced and run at right angles to the slots. These teeth 17 of the spine hinge 10 tapes 11 are used to lock together the spine hinge elements locking into the pawl slots 12 of the complementary spine hinge 19. A brief description of the pawl slot 12 is given together with a discussion of FIG. 7.

Continuing in reference to FIG. 4, both spine hinge elements 10 & 19 have a large toothed book cover tab 13 which are used to secure a pre-slotted cover 40 to the completed book. The spine hinge elements may also have a "French groove" 14 fashioned into the element to act in part in "hinging" the book cover.

FIG. 5 is a cross sectional view aa of the slot 15 between two adjacent spine tapes U showing the attachment of one of the signature comb tooth 22 tabs 23 & 24 of the signature comb 20. The sill 16 of the slot 15 retains the tab slot between tabs 23 and 24. "Dim" refers to the dimension between the back of the signature comb 21 and the "front" of the spine tapes 11 as determined by the dimension of signature comb tooth tab 24. This dimension is determined by the number and thickness of the signatures pages to be bound and further takes into account the distortion of the paper as a consequence of the fold. The back edge of signature comb tab 24 may, in this configuration, come to rest between the rows of the teeth 17 on the spine tapes 11 further securing the signatures to the spine. Signature combs with a range of tab 24 dimensions would be manufactured and standardized to accommodate various paper weights and signature page numbers typically bound. Signature combs suitably standardized could be mixed in a given binding to adjust the total number of pages bound in a given book.

Figure 6:
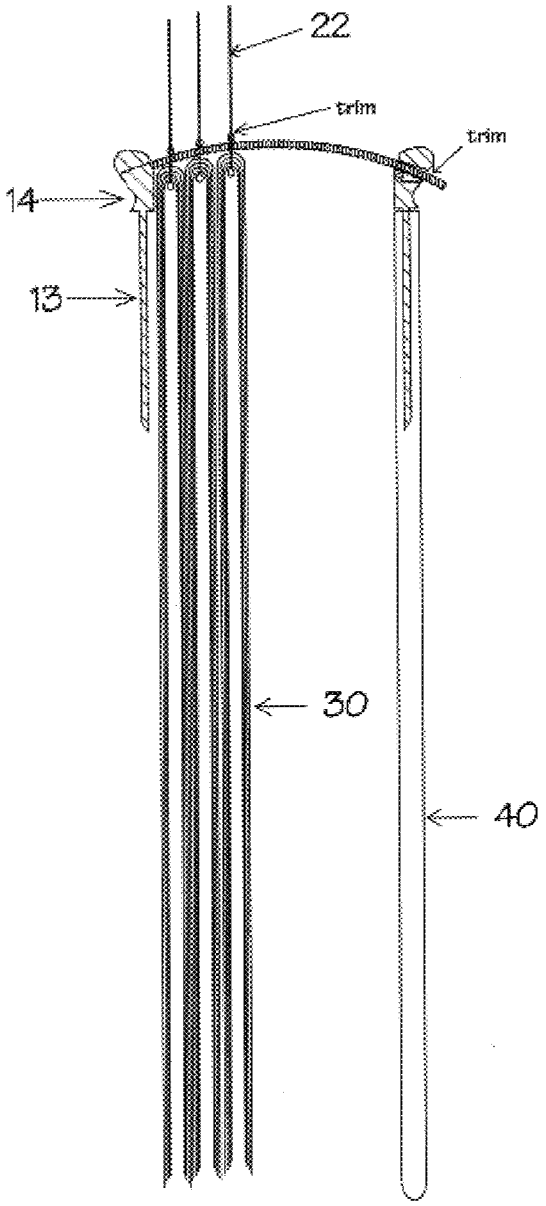

FIG. 6 is a plan view of the bookbinding device from the "head"(or "tail") of the book showing signatures 30 attached to the spine elements 10 and 19 by the teeth 22 of the signature combs 20. Once binding is secured, FIG. 6 indicates "trim" points where excess signature comb teeth 22 and spine tapes 11 are trimmed flush to the binding with a suitable cutting tool. A pre slotted cover board 40 is also shown attached to one of the spine hinge elements.

Figure 7:
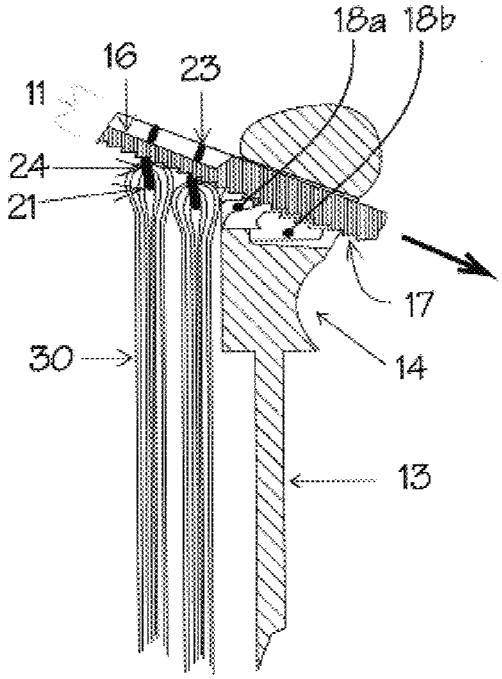

FIG. 7 is an enlargement of one edge of a bookbinding showing the insertion and locking of the spine tape 11 teeth 17 into the pawl slot 12 (see FIG. 4) being held in the slot by the pawl 18*b* and pawl stop 18*a*. The operation of the "tooth" and "pawl" lock has been fully described in the disclosure of U.S. Pat. No. 3,965,538; Caveney et al. "Integral Cable tie" (now expired). The spine tab with the teeth oriented as shown in FIG. 7 can be progressively inserted into the pawl slot in the direction indicated by the arrow.

Once the teeth engage the pawl the tape cannot be withdrawn and is locked into position. The spine tape can be inserted further into the pawl slot, limited by the thickness of the signatures bound between the spine hinges 10 and 19, effectively clamping the pages of the book together very tightly.

FIG. 7 also is shown with the signature comb teeth trimmed flush with the signature comb tab 23 and the spine tape back U and resting on the slot sill 16.

Figure 8:
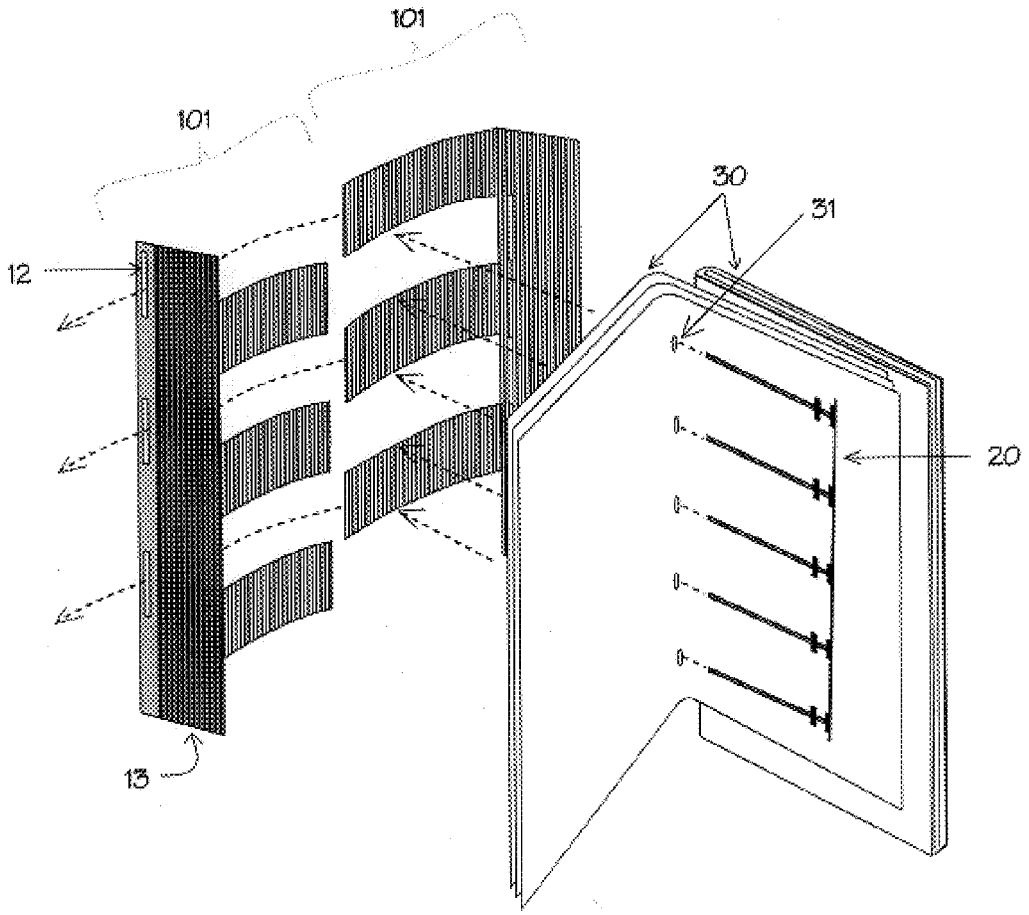
Figure 9:
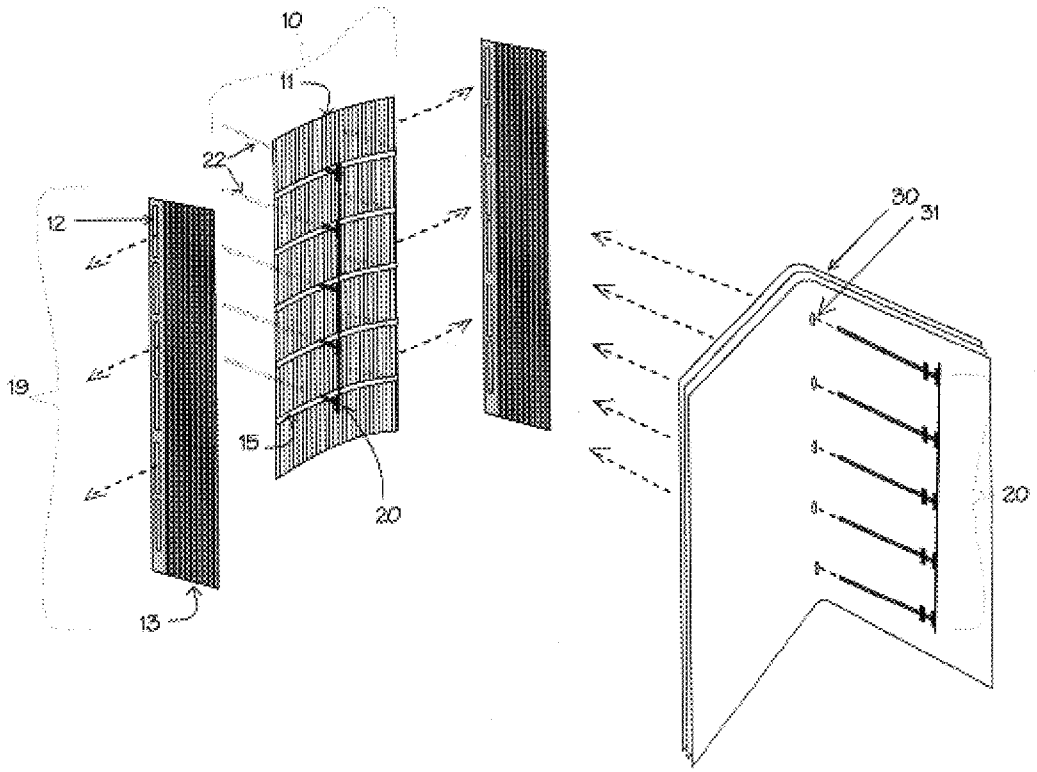
Figure 10:
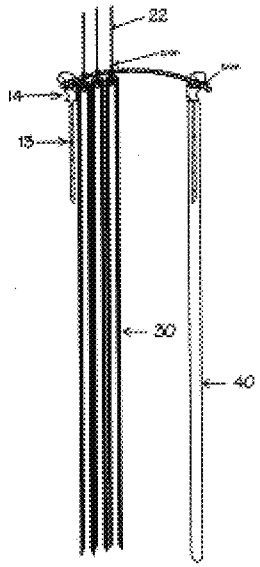

FIG. 8 diagrams an exploded view assembly drawing of a variation to the embodiment of the bookbinding signature comb and spine device where the spine hinge elements 101 are identical in fabrication and manufacture being bilaterally symmetrical about an axis perpendicular to the plane to the spine tapes 11. The spine hinges 13, being identical, contain alternating spine tapes 11 and pawl slots 12, and all other parts of the spine hinge 13 being common.

FIGS. (9 & 10) is a variation of a preferred embodiment where the spine hinges are both identical, both of the pair having pawl slots that accept individual spine tapes. Both hinges can be progressively inserted with the toothed spine tapes thus clamping together a number of signatures secured by the signature combs.

Notwithstanding the ease and simplicity of the self locking signature comb and spine tape/pawl hinge arrangement, it may be desirable to further secure the signature comb teeth to the spine tapes, and the spine tapes to the hinge by means of ultrasonic welding or fusion of the polymer elements. In some variation of this embodiment, the spine teeth and pawl may be dispensed with in favor of ultrasonic welding as for moderate volume production bookbinding.

It is seen that with the signature combs, spine tapes and pawl slot hinges with covering material assembling a collection of signatures into book form requires no glue, clamps, or special tools or machinery. If a comparatively large number of books are to be assembled at one time, a simple jig to hold the signatures as collected might facilitate the procedure but are by no means necessary. A variety of book covering methods can be incorporated into the pawl slot hinge configuration including soft paper, soft plastic, hardboard, cloth, and so forth. These may be detachable or manufactured to be both cover and "pawl slot hinges" as one piece. Further, cover titling or graphics can be added as desired by a variety of means. One or a few styles of covering systems might be readily at hand and individual titles and graphics can be added by printing from a desktop printer.

Printing a book to be bound in signatures requires printing the text as four pages to a single sheet (to be later folded) and this will require proper imposition or collation of each page into the proper sheet and position on the sheet so that the pagination is correct within the final folded signature. However, while once the province of the typesetter, digital computer software specifically designed for print layout often has this feature so that when the text is printed, imposition and pagination are correct for binding into signatures and a number of signature sections bound together to form the complete book.

For a small bookbinding task printing from a computer and desktop printer, there are two practical limitations to the use of the present invention. First, paper of the desired dimension —if other than standard 8 ½×11—must be obtained and once printed, slots properly spaced cut along the fold line. While this can be done by hand, it would be desirable to have as part of this technique a slot cutter similar to a three-hole paper punch. Precut paper of various standard dimensions could be made available to eliminate the need for a special slot cutter. The second limitation is the need to have quality paper which when folded has the proper orientation of grain (if any) and folds so that the paper does not bulge at the crease; further the edges of each sheet when folded in a multi sheet signature will not be flush unless trimmed. These problems can be addressed by manufacturing special paper having the proper grain and slotted or pre-perforated along the desired fold line and so scored as to reduce or eliminate bulging; and further supply the paper in predetermined signature sections cut on a bias so that when folded along the score, the edges of the sheets are flush having no fold deckle. Such multi-page signatures made using laser-perforated bond papers have been disclosed by Perrington et al. in U.S. Pat. No. 5,557,331; Sept. 17, 1996 the discussion of which is incorporated herein by reference.

Reasonable variations and modifications are possible from the foregoing disclosure without departing from either the spirit or scope of the present invention as defined by the claims.

What is claimed is:

1. A device for the binding of books in signatures comprising the combination of:

one or more signature combs, each signature comb having a spine and at least two or more teeth attached to, or integral to, the spine, all such teeth on the same plane with each other and the spine and at right angles to a back of spine; further each tooth of the signature comb having at least one tab at a right angle to the tooth and to the signature comb spine;

two or more tapes having teeth arranged in rows transverse to the longitudinal axis of the tape, where the tapes pass between the tabs of the signature comb and a back edge of one or more folded signatures, and forming one or more slots transverse to the spine of the book of a width sufficient to accept the teeth of the signature comb thus securing the signature sheets to the spine of the resulting book by capturing the tapes of each signature comb tooth between and over the back of the tapes;

a pair of hinge elements, each element having two or more pawl slots, corresponding to the number of tapes used, the pawl slots incorporating a rasp element and each slot being the width of the tape or band through which the tapes are inserted so that the rasp elements engage the teeth of the tape or band engaging the tape or band securely to the hinge elements and further securing the signatures together and the pair of hinge elements.

2. A device for the binding of books in signatures as set forth in claim 1 wherein the tapes, having teeth arranged in rows transverse to the longitudinal axis of the tape, are attached or are integral to both of the hinge elements, alternating with correspondingly spaced pawl slots to accept the tapes attached to or integral to the opposing hinge element.

3. A device for the binding of books in signatures as set forth in claim 1 wherein the hinge elements are tabbed to fit into the slot of a detachable cover material.

4. A device for the binding of books in signatures as set forth in claim 6 wherein the tapes, having teeth arranged in rows transverse to the longitudinal axis of the tape, are attached or are integral to one of the pair of hinge elements, the second hinge element having correspondingly spaced pawl slots to accept the tapes.

* * * * *